US005159954A

United States Patent [19]

Janich

[11] Patent Number: 5,159,954

[45] Date of Patent: Nov. 3, 1992

[54] HINGED SAFETY-VALVE FOR LARGE DUCTS

[75] Inventor: Hans-Jürgen Janich, Beckum, Fed. Rep. of Germany

[73] Assignee: Mannesmann Aktiengsellshaft, Düsseldorf, Fed. Rep. of Germany

[21] Appl. No.: 767,264

[22] Filed: Sep. 27, 1991

[30] Foreign Application Priority Data

Sep. 27, 1990 [DE] Fed. Rep. of Germany ..... 4030611

[51] Int. Cl.[5] ..... F16K 37/00

[52] U.S. Cl. ..... 137/557; 137/246.22; 137/551; 137/599; 251/298; 251/356; 73/49.8

[58] Field of Search ..... 137/551, 557, 599, 246.22; 251/298, 299, 356; 73/49.8

[56] References Cited

U.S. PATENT DOCUMENTS

| | | | |
|---|---|---|---|
| Re. 31,471 | 12/1983 | Hagar | 137/246.22 X |
| 1,826,941 | 10/1931 | LaMont | 137/246.22 X |
| 1,990,309 | 2/1935 | Phillips | 137/246.22 |
| 2,430,122 | 11/1947 | Grace, Jr. | 137/551 |
| 2,603,451 | 7/1952 | Brown | 251/356 |
| 2,691,773 | 10/1954 | Lichtenberger | 137/557 |
| 3,749,115 | 7/1973 | Raftis | 137/246.22 |
| 3,835,878 | 9/1974 | Braidt et al. | 137/557 X |
| 4,003,394 | 1/1977 | Adams | 137/246.22 X |
| 4,077,432 | 3/1978 | Herr | 137/601 |
| 4,187,878 | 2/1980 | Hughey | 137/246.22 X |
| 4,335,738 | 6/1982 | Nassir | 137/246.22 |
| 4,512,356 | 4/1985 | Widerby | 251/298 X |
| 4,638,833 | 1/1987 | Wolcott, II | 137/551 X |
| 4,800,919 | 1/1989 | Bachmann | 251/356 X |
| 5,000,422 | 3/1991 | Houston | 137/246.22 X |

*Primary Examiner*—John Rivell

*Attorney, Agent, or Firm*—Nils H. Ljungman and Associates

[57] ABSTRACT

This invention relates to a shutoff mechanism, in particular in the form of a hinged safety-valve for large gas ducts, which contains a plate-shaped shutoff body which can be pressed against a seat on the housing. To guarantee a reliable and secure shutoff of large gas lines, the shutoff mechanism, together with an additional cover, forms a gas-tight chamber closed off from the two chambers of the gas line. The pressure in this chamber is monitored and is different from the pressures in the two chambers of the gas line.

20 Claims, 8 Drawing Sheets

32
31
33
4
28
28
29
27
26
31a
29
15
13
25
30
1
24
14

HINGED SAFETY-VALVE FOR LARGE DUCTS

BACKGROUND OF THE INVENTION

1. Field of the Invention

The invention relates to a shutoff device for a gas or line, in particular one having a large cross section, with a gas duct or line housing which can be integrated into the gas duct and with at least one shutoff mechanism, in particular a movable shutoff valve, whereby the shutoff mechanism has a plate-shaped shutoff body, which in the shutoff position is in sealed contact against a seal seat permanently connected to the gas line housing, thereby separating the chambers of the gas line located on different sides of the shutoff mechanism from one another, and whereby the seal seat in the peripheral region of the plate-shaped shutoff body extends around its entire circumference.

2. Background Information

Shutoff devices of the type mentioned above are used in practice in many different embodiments. To shut off lines conducting gas and exhaust gas, i.e. pipelines and ducts, for example, the prior art includes the use of blank disk inserts, which employ the principle of a blind flange shutoff.

Since the capacity of current and future systems will continue to increase, the corresponding gas lines must also be designed with increasingly greater dimensions. In the course of these increases in capacity, the responsible safety authorities have also allowed or certified safety devices which contain two shutoff valves located one behind the other in the direction of the gas flow, i.e. two shutoff levels, one some distance behind the other. The space thereby formed between the shutoff valves, however, must be filled with a buffer or barrier medium, the pressure of which buffer medium is higher than the forward pressure—i.e. the pressure of the first shutoff valve—in the gas flow direction. The buffer medium prevents the passage of the potentially dangerous gas, so that maintenance personnel are not exposed to the gas. The buffer medium can be air.

A further consideration with these gas lines to be shut off is that they often transport corrosive gases, e.g. exhaust gases from coal-fired boiler systems, when they are used as part of an exhaust gas desulfurization system. When operating conditions cause the temperature to fall below the acid dew point of these gases, highly-concentrated acids are formed very quickly. These acids precipitate on the cold sides of the valves of a closed shutoff valve and cause corrosion damage there (e.g. so-called "pitting"). Damages of this type can be detected on the double valves described above as a result of a drop in the pressure of the buffer medium, so that appropriate measures can be taken to repair these damages before there is acute danger to the lives of the operating and maintenance personnel. In other words, the damaged valve would allow the dangerous gas to pass, which could put the operating personnel in danger. It can be easily understood, however, that these shutoff devices, with several shutoff valves and/or shutoff levels located in series, not only take up a relatively great amount of space, but are also relatively expensive.

OBJECT OF THE INVENTION

The object of the invention is, therefore, to create a shutoff mechanism of the type described above which, while meeting the requirements of the applicable safety specifications, is characterized by its compact and relatively simple structure.

SUMMARY OF THE INVENTION

This object is achieved by the invention characterized by the fact that the shutoff mechanism has an additional cover, which together with the shutoff body forms a chamber closed gas-tight from the two chambers of the gas line, wherein the pressure of this chamber is different from the pressure in the two chambers of the gas line, and which is connected to a pressure monitoring device.

The invention contains the shutoff mechanism, in particular a movable or swivelling shutoff valve, an additional cover which is located at a sufficient distance from the plate-shaped shutoff body so that this cover, together with the shutoff body, forms an enclosed space, cavity, or hollow body and, thus, forms a closed chamber which is gas-tight in relation to the two chambers of the gas line. Inside this closed chamber, a pressure is established or maintained which is different from the pressures in the two chambers of the gas line (ahead of and behind the shutoff valve). For this purpose, a pressure monitoring device is connected to the closed chamber.

If, when this shutoff mechanism according to the invention is used in a shutoff device for gas lines, the pressure inside the gas-tight closed chamber of the shutoff mechanism or shutoff valve changes from a preset pressure, the change can indicate damage to the additional cover or to the plate-shaped shutoff body. However, the escape or overflow of gas to or from the gas chambers of the corresponding gas line is not possible on account of the structure according to the invention. This monitoring of the complete operational readiness of the shutoff mechanism is guaranteed both in the closed position and also in the opened position of this shutoff mechanism or shutoff valve.

The result is a significant difference in function compared to the shutoff mechanism of the prior art for gas lines, as disclosed in U.S. Pat. No. 4,077,432, whose shutoff mechanism has a so-called louver shutoff valve arrangement. That term is used to define a shutoff apparatus with several shutoff valves in a single plane, located close to one another, which can be rotated around their central axes into the open position, such that the flat sides of the shutoff valves are approximately parallel to the axis of the gas line, i.e. in the flow direction, and still represent only a relatively small obstacle to the flow of the gas. In a typical arrangement of such louver shutoff valves, the seal between two louver shutoff valves next to one another must be produced by direct contact between the two louvers, and fixed seal seats against which the louver shutoff valves can rest exist only in the vicinity of the pipeline jacket or the housing of this shutoff device. The result, of course, is that, for a secure seal against harmful gases, the introduction of buffer air in a buffer air duct circulating between the louver shutoff valves and the stationary seal seat formed on the inside of the gas line is easily possible, since the buffer air duct is easily accessible from the outside. On the other hand, the feed of buffer air into the vicinity of the seal between the immediately adjacent louver shutoff valves is not so easy. To solve this problem, U.S. Pat. No. 4,077,423 discloses the use of rotating shafts for the individual louver shutoff valves which are designed as hollow shafts, for the introduction of buffer air. This buffer air is allowed to flow through the hollow louver shutoff valves and is allowed to exit at their narrow end surfaces through passages into the buffer air ducts, whereby there is also a buffer air duct formed in the area between each two louver shutoff valves forming a seal directly against one another.

This apparatus of the prior art only solves the problem of the introduction of the buffer air. There is no indication in the prior art of the possibility of detecting leaks in the shutoff surface of the shutoff mechanism. The invention differs from the prior art, in particular as a result of the fact that it establishes a very specific pressure in the closed chamber of the shutoff mechanism, and monitors whether this pressure changes, i.e. whether the chamber has a leak, which always represents a yardstick for damage to the walls of this chamber.

In the device of the prior art, on the other hand, leaks occur regularly in the vicinity of the buffer air ducts, since there are always dust deposits in the vicinity of the seals or sealing surfaces. To that extent, even in the case of a pressure monitoring of the buffer air feed (which is not disclosed in U.S. Pat. No. 4,077,432), there is no reason to expect any reliable detection or indication of damage to the shutoff body.

Minor damage in particular, i.e. incipient damage, can easily go undetected. But with the solution proposed by the invention, such a case can be easily controlled, because even if the shutoff body is open, i.e. if there is no feed of buffer air, there can be a continuous monitoring of the shutoff bodies for leaks.

The pressure monitoring apparatus can be advantageously located on the outside of the gas line housing, and in the connecting line between the gas-tight chamber and an external pressure source for a shutoff medium, preferably a gaseous buffer medium, whereby the pressure monitoring apparatus is appropriately connected by means of a flexible hydraulic or pneumatic line to the closed, gas-tight chamber in the shutoff mechanism.

Basically, a specified underpressure or overpressure can be established by means of the monitoring apparatus and then maintained.

Since with an undamaged shutoff mechanism, no buffer medium can escape from the gas-tight, closed chamber, the use of a relatively small pressure source is sufficient, e.g. the use of a simple, small bladder or bubble reservoir.

As a result of this configuration according to the invention, even with relatively large dimensions of the corresponding gas lines, there need only be one shutoff plane (compared to the shutoff devices of the prior art, with two shutoff planes or shutoff mechanisms one behind the other) for each shutoff apparatus, which on one hand takes up less space and on the other hand makes possible a relatively simple overall structure, in particular with regard to the entire corresponding shutoff apparatus.

The invention is explained in greater detail below, with reference to the embodiments illustrated in the accompanying drawings.

One aspect of the invention resides broadly in a valve apparatus for a gas duct, the gas duct having a first duct chamber on a first side of the valve apparatus and the gas duct having a second duct chamber on a second side of the valve apparatus, said valve apparatus comprising: a valve apparatus housing for being integrated into the gas duct; a shutoff door being movably mounted on said valve apparatus housing, said shut off door for opening and closing the valve apparatus, and for selectively separating the gas duct into the first duct chamber and the second duct chamber, and for selectively shutting off gas flow between the first duct chamber and the second duct chamber; a seal seat connected to said valve apparatus housing, said seal seat for sealing between said valve apparatus housing and said shutoff door when said shutoff door is in a closed position; and a body chamber formed within said shutoff door, said body chamber being substantially gas-tight and being separate from the first and second duct chambers, and said body chamber being configured for having a body pressure therein which body pressure is different from the pressure within the first duct chamber and also different from the pressure within the second duct chamber, said body chamber having means for connection to a source for providing the different pressure within said body chamber, and said body chamber having means for connection to a pressure monitoring device.

Another aspect of the invention resides broadly in a valve apparatus for a gas duct, the gas duct having a first duct chamber on a first side of the valve apparatus and the gas duct having a second duct chamber on a second side of the valve apparatus, said valve apparatus comprising: a shutoff door, for being moveable within the gas duct, for sealing against a seal seat when in the closed position thereby separating the gas duct into the first duct chamber and the second duct chamber, and for shutting off gas flow between the first duct chamber and the second duct chamber; and a body chamber formed within said shutoff door, said body chamber being substantially gas-tight and being separate from the first and second duct chambers, and said body chamber being configured for having a body pressure therein which body pressure is different from the pressure within the first duct chamber and also different from the pressure within the second duct chamber, said body chamber having means for connection to a source for providing the different pressure within said body chamber, and said body chamber having means for connection to a pressure monitoring device.

DESCRIPTION OF THE PREFERRED EMBODIMENTS

Figure 1:
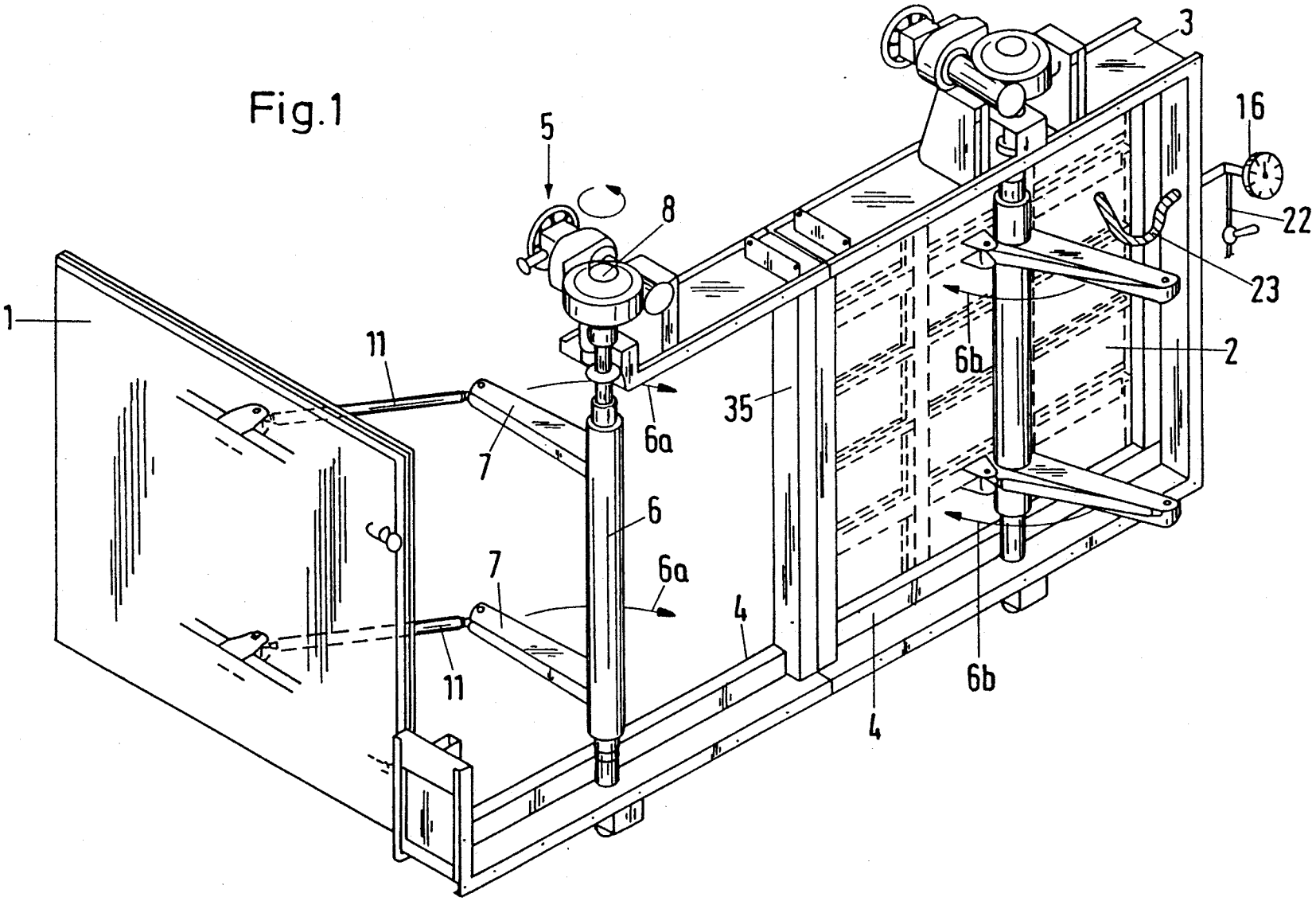
FIG. 1 shows a perspective view (with some parts of the housing removed) of a first embodiment of a shutoff apparatus with two movable shutoff valves located next to one another as shutoff mechanisms.
Figure 2:
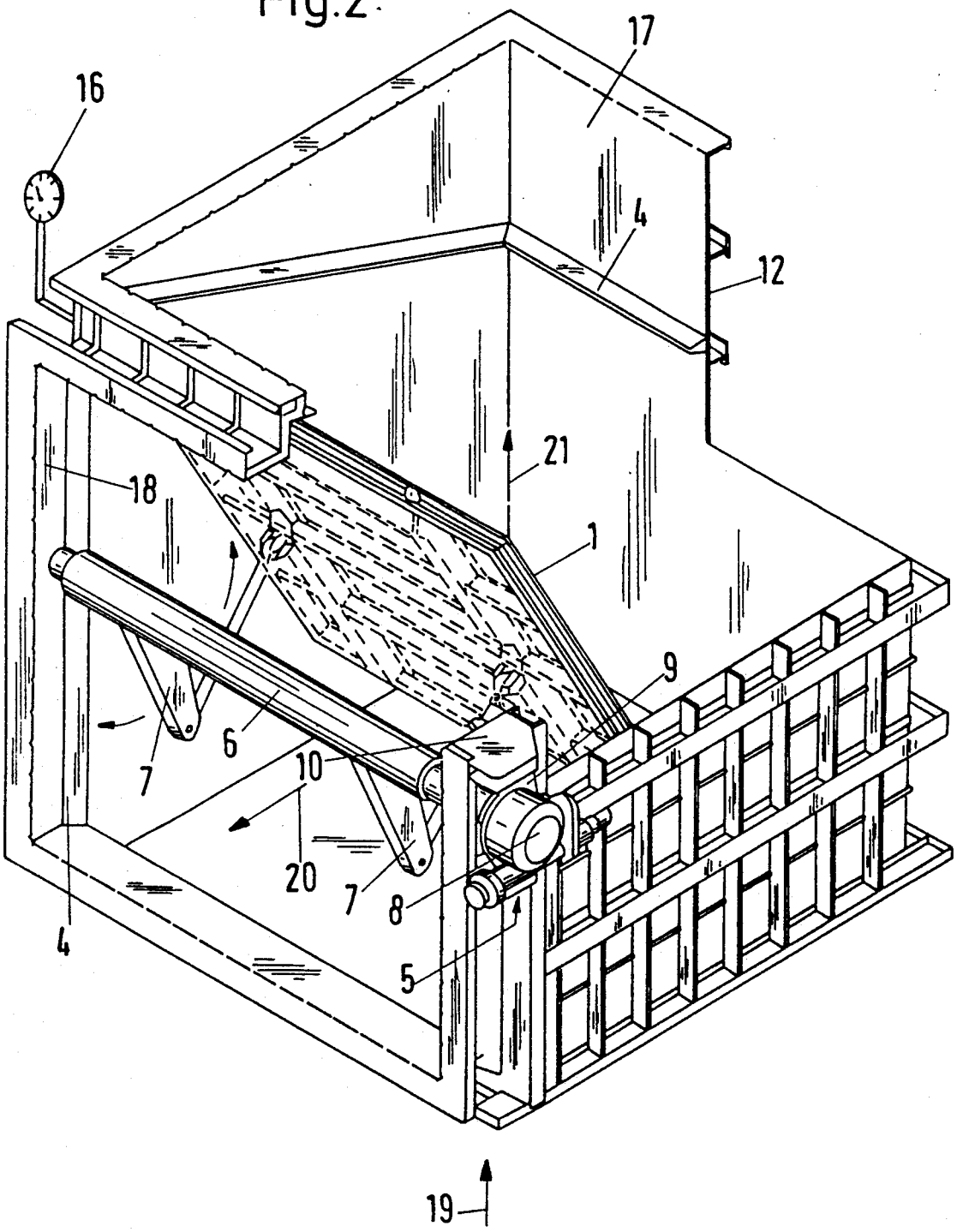
FIG. 2 shows a perspective view (with some parts of the housing removed) of a second embodiment of a shutoff apparatus in the form of a gas shunt with a movable shutoff valve as the shutoff mechanism.

FIGS. 1 and 2 show two principal applications of the shutoff mechanism according to the invention, whereby this shutoff mechanism is used in the form of the particularly preferred movable shutoff valve, and is always used in gas lines of relatively large dimensions.

In the embodiment illustrated in FIG. 1, there are two movable shutoff valves or shutoff doors 1 and 2 in a large-diameter gas line—viewed in the direction of the gas flow—next to one another in the housing 3 of a corresponding shutoff apparatus, whereby the first shutoff valve 1 and the second shutoff valve 2 can be identically designed and identically driven, and thus, can each cut off or open up one-half of the cross section of the housing 3. The free cross section of the housing 3 can thereby correspond to a gas line, not shown here in any further detail.

In FIG. 1, the first shutoff valve 1 shown on the left is in its fully open position, and the second shutoff valve on the right is in its fully closed position.

The shutoff valves 1, 2, in their shut off position, are in tight contact with a stationary seal seat 4 (on the inner walls) inside a housing 3 having a center web 35. The seal seat 4 runs around the entire inside circumference of the housing 3, and is in sealed contact with the entire circumferential edge of each shutoff valve 1, 2, when the corresponding shutoff valve is closed. The seal seat 4 also runs along the center web 35, so that sealed contact is made with the entire circumferential edge of each shutoff valve 1, 2. In this manner, the chambers of the gas line located on different or opposite sides of the shutoff valves 1, 2 are separated from one another.

If we first consider only the first, open shutoff valve 1 of the two identically designed and activated shutoff valves, we see that this first shutoff valve, and each shutoff valve, is closed by means of a valve activation shaft 6 which can be rotated by a drive apparatus 5 in the direction of the arrow 6*a* and—on the closed, second shutoff valve 2—can be opened as shown by the arrow 6*b*. For this purpose, the valve activation shaft 6 has a plurality of activation arms 7 permanently connected to it, which by means of hinged connecting rods 11 are engaged with the one side of the shutoff valve 2 or 1.

On one end of each valve activation shaft 6, there can be a suitable transmission 8, which is a part of the drive apparatus 5.

Figure 1A:
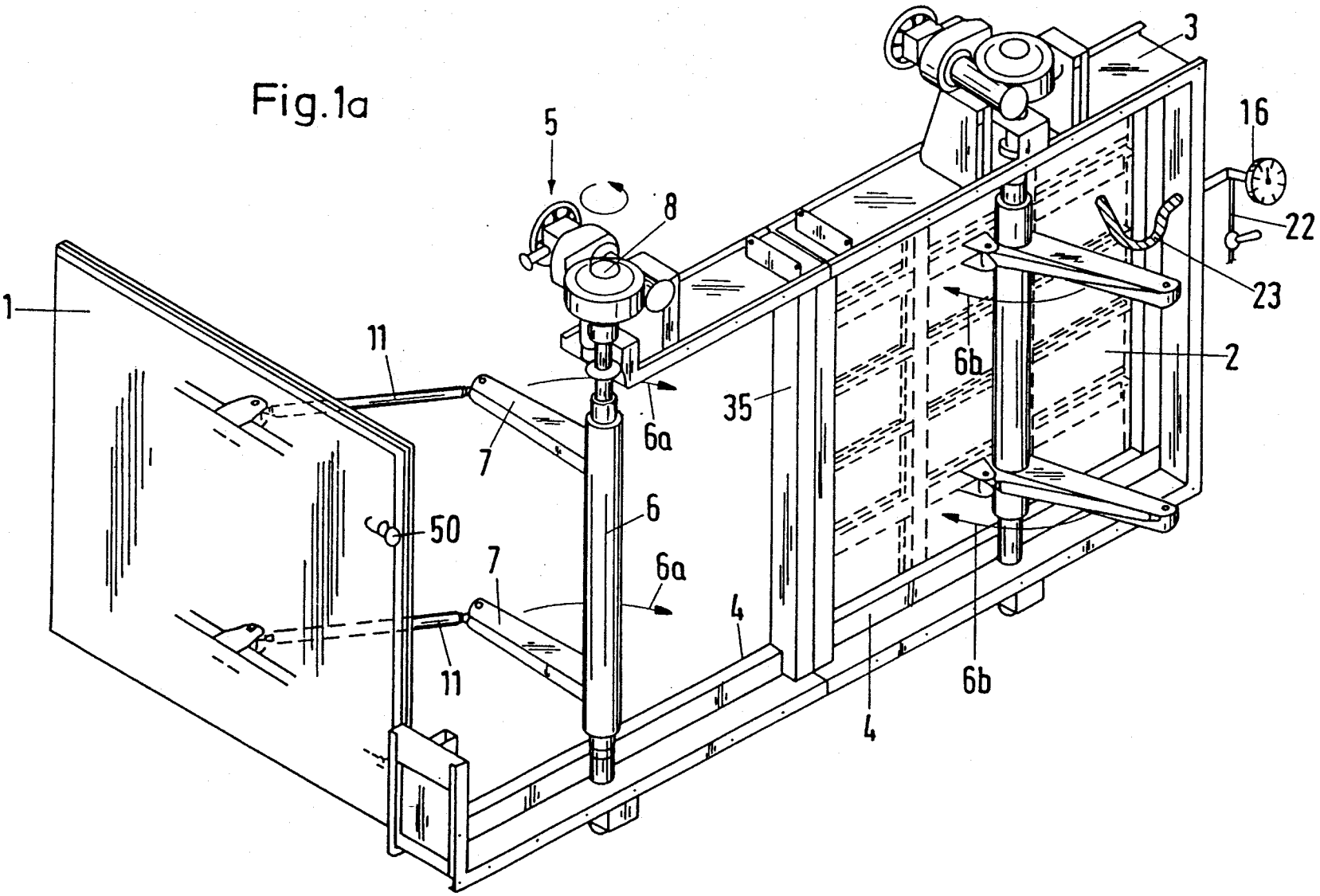
FIG. 1*a* shows a perspective view (with some parts of the housing removed) of a first embodiment of a shutoff apparatus with two movable shutoff valves located next to one another as shutoff mechanisms.

FIG. 1*a* shows the shutoff apparatus. Movable shutoff valve 1 preferably has hinge 50 on which shutoff valve 1 pivots when being opened or closed. Hinge 50 movably mounts shutoff valve 1 on housing 3. Both shutoff valves 1, 2 can have hinges 50, and each shutoff valve 1, 2 can have two or more hinges 50.

The embodiment illustrated in FIG. 1 shows that there can be a shutoff device for gas lines of relatively large dimensions, and with single-vane or multi-vane movable valves (in the latter case, located next to one another), whereby each vane of such a movable valve is formed by a movable shutoff valve.

An additional, particularly favorable application of the shutoff mechanism according to the invention is its use in the form of a movable shutoff valve in a gas shunt, as shown in FIG. 2. In this case, however, only one movable shutoff valve is used, which can be designed in the same manner as the first shutoff valve shown in FIG. 1, so that it has also been designated 1.

The lines or ducts are large and can have dimensions about one meter across, 2 meters across, 3 meters across, or more.

In the case of FIG. 2, the shutoff valve 1 is used to transport an incoming gas current symbolized by arrow 19 either via a first branch connection 17 in the direction of the arrow 21—as shown in FIG. 2—or via a second branch connection 18 in the direction of the arrow 20. The shutoff valve 1 can in turn be pressed by the valve activation shaft 6 via activation arms 7 and activation linkages 11 either against the seal seat 4 in the area of the second branch connection 18, or against the seal seat 4 in the area of the first branch connection 17. The rotational movement of the valve activation shaft 6 in either direction can in turn be generated by the drive apparatus 5 with the transmission 8, whereby the ends of the activation shaft 6 are mounted in shaft bearings 9 with bearing housings 10.

If we also consider the partial perspective view in partial cross section in FIG. 3 (detail) through the circumferential edge area of a shutoff valve, e.g. 1, the seal seat 4 which interacts with the circumferential edge of a shutoff valve and the sealing elements interposed between them (and which will be explained in greater detail below), then we see that each of shutoff valves 1, 2 forming a shutoff mechanism has a closed cavity or a closed chamber 13. This chamber 13 results from the fact that each movable shutoff valve 1, 2 contains as its main component a flat continuous or plate-shaped shutoff body 14 and a preferably also plate-shaped additional cover 15, the two of which are at a sufficient distance from one another and are oriented essentially parallel to one another, and are connected to an essentially plane, plate-shaped and sufficiently dimensionally stable component. The plate-shaped shutoff body 14 and the additional cover 15 thereby together form the closed chamber 13, which is gas-tight in relation to the chambers of the gas line (ahead of and behind each shutoff valve). This chamber 13 or its interior is pressurized at a pressure (underpressure or overpressure), which differs from the pressures which prevail in the two chambers of the gas line ahead of and behind each shutoff valve 1, 2. To maintain the above-mentioned pressure in the gas-tight chamber 13 in the required manner, the chamber 13 is connected to a pressure monitoring device designated 16 in FIGS. 1 and 2.

The pressure monitoring device 16 is preferably located on the outside of the corresponding housing 3 (in FIG. 1) and 12 (in FIG. 2). It is also located in a connecting line between the chamber 13 and a suitable pressure source of the prior art (therefore not illustrated or explained in any further detail}for a buffer medium, whereby the connection to the pressure source is indicated by a closable line segment 22, while the connection between the pressure monitoring apparatus 16 and the gas-tight chamber 13 of each shutoff valve 1, 2 is formed essentially by a flexible pressure medium line 23 (See FIG. 1), so that the pivoting movement of the corresponding shutoff valve is not interfered with by the connecting line to the pressure monitoring device.

It should also be mentioned in this context that it is important, when the line 22 is blocked, to maintain the pressure (underpressure or overpressure) inside the gas-tight chamber 13 in each shutoff valve 1, 2 at a level which is significantly different from the pressure in the two chambers of the gas line, so that as soon as leaks occur in the shutoff body 14 or the cover 15, these leaks can be indicated by a corresponding change in pressure at the pressure monitoring device 15, so that measures to repair the damage can be taken immediately.

If we assume that with a closed shutoff valve—once again observing the apparatus in the direction of gas flow—there is a pressure P1 ahead of each shutoff valve 1 and 2, and a pressure P3 behind each shutoff valve, and a pressure P2 inside the gas-tight closed chamber 13 of the shutoff valve, the following pressure conditions can exist during operation:

P1 is less than P2 is greater than P3
P1 is greater than P2 is less than P3
P1 is greater than P2 is greater than P3
P1 is less than P2 is less than P3.

In addition, when the shutoff valve is open, a pressure P1 can be generated or maintained inside the gas line and a pressure P2 inside the closed, gas-tight chamber 13 of the shutoff valve, whereby these pressures P1 and P2 must always be different from one another.

Several possible configurations of the circumferential edge of the shutoff valve on one hand, and of the housing seal seat on the other hand will be explained in greater detail below, with reference to the partial cross sections in FIGS. 3 to 7, along with configurations for the sealing elements or gaskets located between them. In all the FIGS. 3 to 7, only one segment of the circumferential edge is shown, using the example of the closed shutoff valve 1, and the corresponding longitudinal section of the housing seal seat 4, on an enlarged scale; the overall arrangement can be easily imagined, by considering the sample applications of the shutoff valve 1, 2 illustrated in a corresponding manner in FIGS. 1 and 2.

Figure 3:
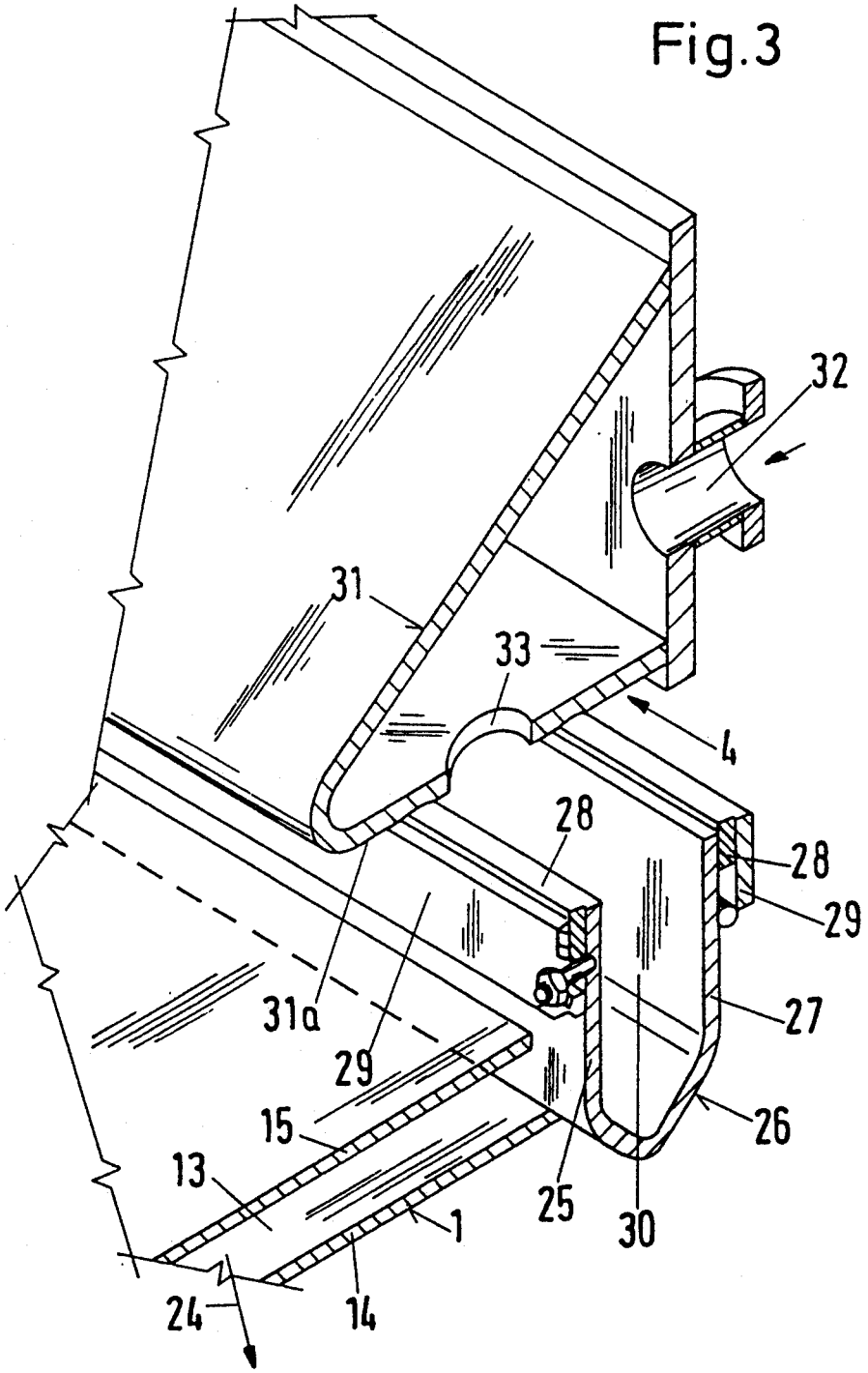
FIGS. 3 to 7 show partial views in perspective (in partial cross section) through the area of the circumferential edge of a shutoff valve and the area of the corresponding seal seat, each for different variant embodiments.

Reference should be made once again to the embodiment illustrated in FIG. 3 and described above. In FIG. 3, the shutoff valve 1, in the direction of the arrow 24 (corresponding to arrows 6*a* and 6*b* in FIG. 1) has a circumferential wall 25 which surrounds the gas-tight chamber 13 toward the circumferential edge of the valve. This circumferential wall 25 connects the plate-shaped shutoff body 14 and the also plate-shaped cover 15 to one another, each in the area of their circumferential edges. In other words, this circumferential wall 25 can be welded gas-tight onto the circumferential edges of the shutoff body 14 and of the cover 15.

In this embodiment (FIG. 3), the circumferential wall 25—shown in cross section—represents only the inner leg of a circumferential groove or channel having a U-shaped cross section, whose outer leg forms an outer circumferential wall 27. As shown in FIG. 3, the circumferential groove 26 with its walls 25 and 27 projects out of the plane of the additional cover 15 toward the seal seat 4, whereby the side of the seal seat 4 facing the circumferential groove 26 is open. On the free edges of the inner circumferential wall 25 facing the seal seat 4 and the other wall 27, there are elastic rubber sealing strips 28 attached by means of connector strips 29 in this embodiment, which provide support for a sufficient seal of the circumferential groove 26 forming the external circumferential edge of the shutoff valve 1 against the housing seal seat 4. This wall of this circumferential groove 26 simultaneously limit a buffer medium cavity 30 which is open toward the housing seal seat 4. This cavity 30 will be explained in greater detail below.

As also shown in FIG. 3, the housing seal seat 4 contains a hollow body 31, and the seal seat 4 is essentially formed by this hollow body 31, which is located on the corresponding inside wall of the housing (approximately as shown in FIGS. 1 and 2). The interior of this hollow body 31 can be pressurized by means of at least one connecting pipe 32 with a buffer medium under pressure, which can be generated by a separate pressure source for the buffer medium, or can also be connected to the gas-tight chamber 13. The side 31*a* of the hollow body 31 opposite the circumferential wall area of the shutoff valve 1, i.e. here the circumferential groove 26, which can also be designated the seal seat surface, has over the length of the hollow body either—as shown in FIG. 3—a number of appropriately distributed passage openings 33, or one or more sufficiently large slots which—as shown in FIG. 3—are sized and placed so that they are closed by the sealing strips 28 bordering the open side of the circumferential groove 26, so that, when the shutoff valve 1 is in sealed contact with the seal seat 4 in its shutoff position, an open connection is created between the inside of the hollow body 31 and the buffer medium chamber 30 of the circumferential groove 26. If, therefore, when the shutoff valve 1 is in the closed position, the inside of the hollow body 31 is pressurized with a suitable buffer medium (preferably a gaseous buffer medium), then at the same time the shutoff valve circumferential edge area is pressurized by the partial chamber 30 of the circumferential groove 26 with this buffer medium. In this manner, an extremely reliable seal is guaranteed between the circumferential edge of the shutoff valve 1 and the housing seal seat 4.

Figure 4:
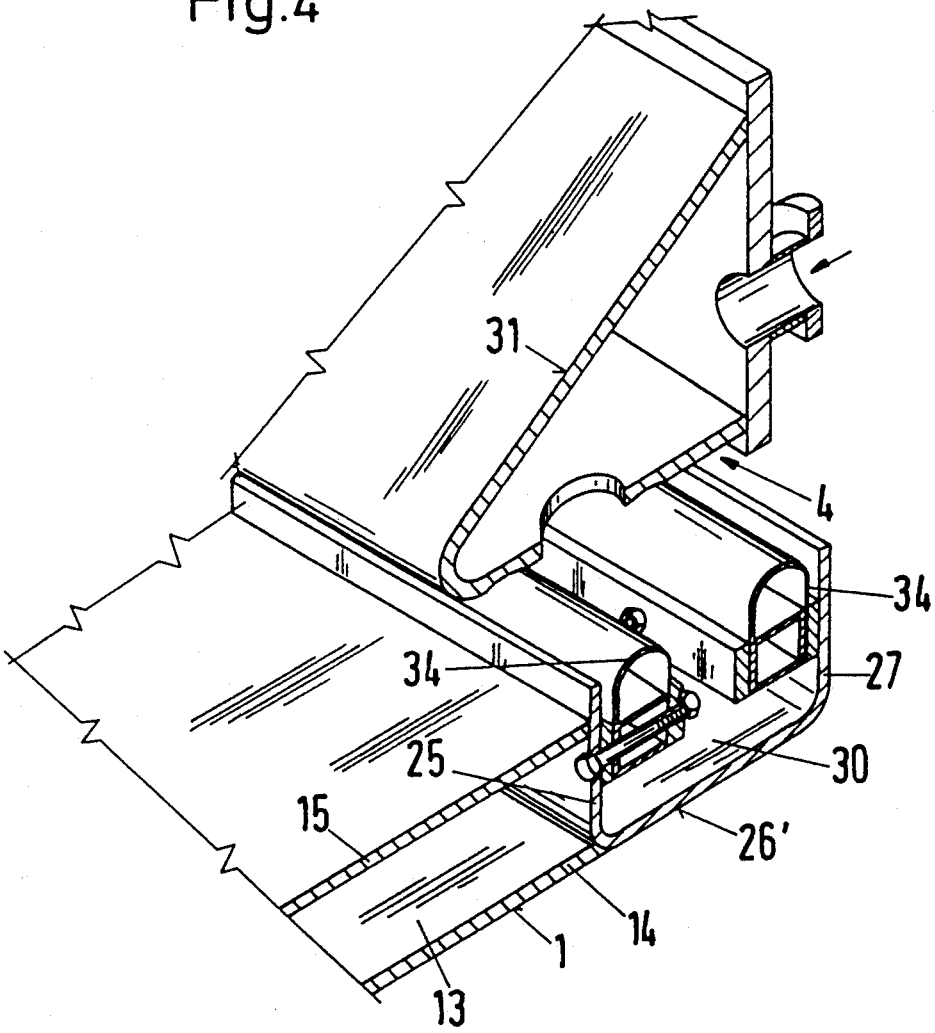

FIG. 4 shows a variant embodiment of the embodiment illustrated in FIG. 3. Since this variant differs from FIG. 3 primarily with regard to the type of sealing elements or gaskets and the corresponding modified circumferential groove, the same reference number can be used for the same components, which means that no repeated explanation is necessary for these parts.

In the case illustrated in FIG. 4, the only difference is that the U-shaped circumferential groove or channel 26′ which essentially forms the outer circumferential edge of the shutoff valve 1 is somewhat wider than the circumferential groove 26 in FIG. 3. On the outer edges of the inner circumferential wall 25 facing the housing seal seat 4 and the outer circumferential wall 27 of the circumferential groove 26′, in this variant embodiment there are circular sealing elements consisting of two spring steel strips 34 bent to an approximately U-shaped cross section, which are clamped to the insides of the circumferential walls 25 and 27, and which, when the shutoff valve 1 is in the closed position, are elastically deformed and in tight contact against the housing seal seat 4.

Figure 5:
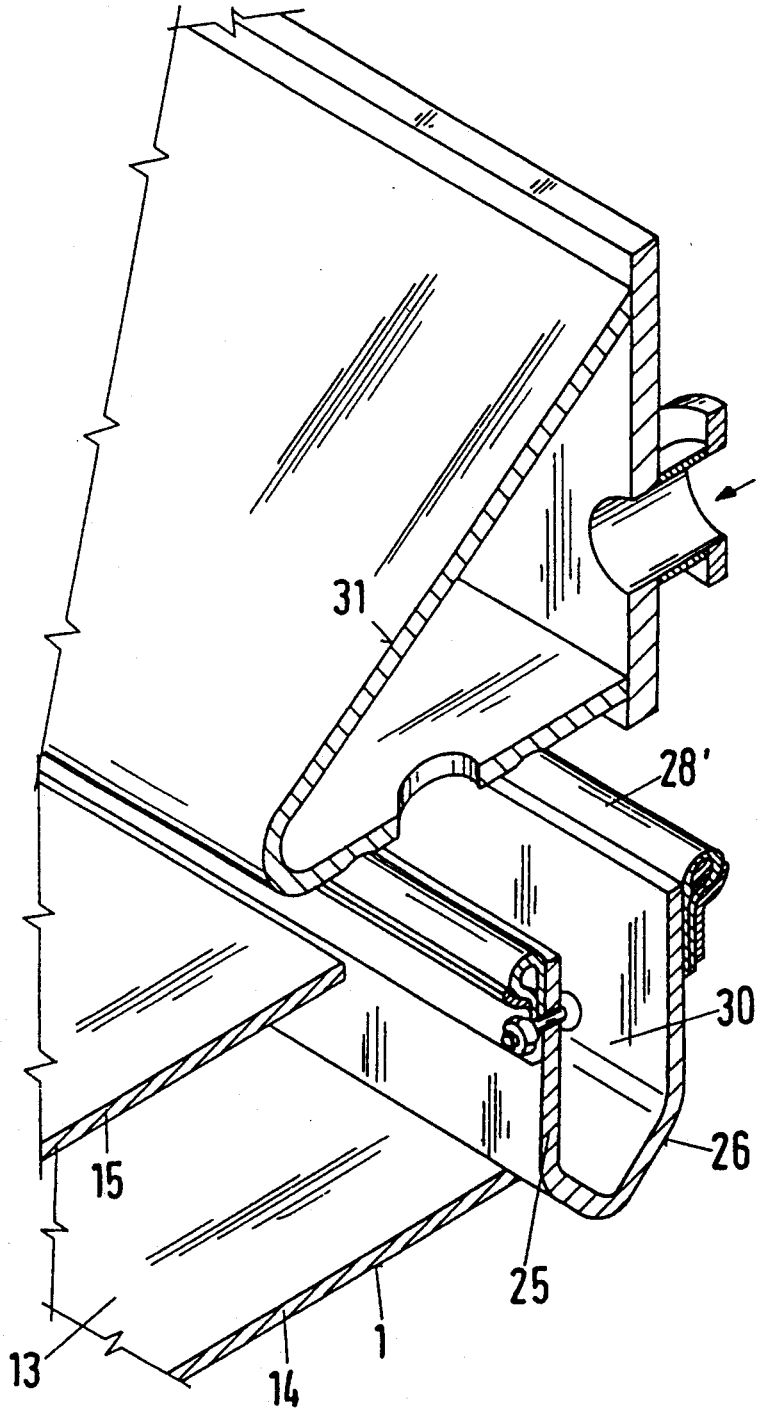

FIG. 5 shows an additional variant embodiment of the configuration illustrated in FIG. 3, so that here again, all the identical parts can be designated by the same numbers. The principal difference between the embodiment illustrated in FIGS. 3 and 4 and this variant embodiment is that the seals 28′ are in the form of weatherstripping seals on the buffer medium partial chamber 30.

Figure 6:
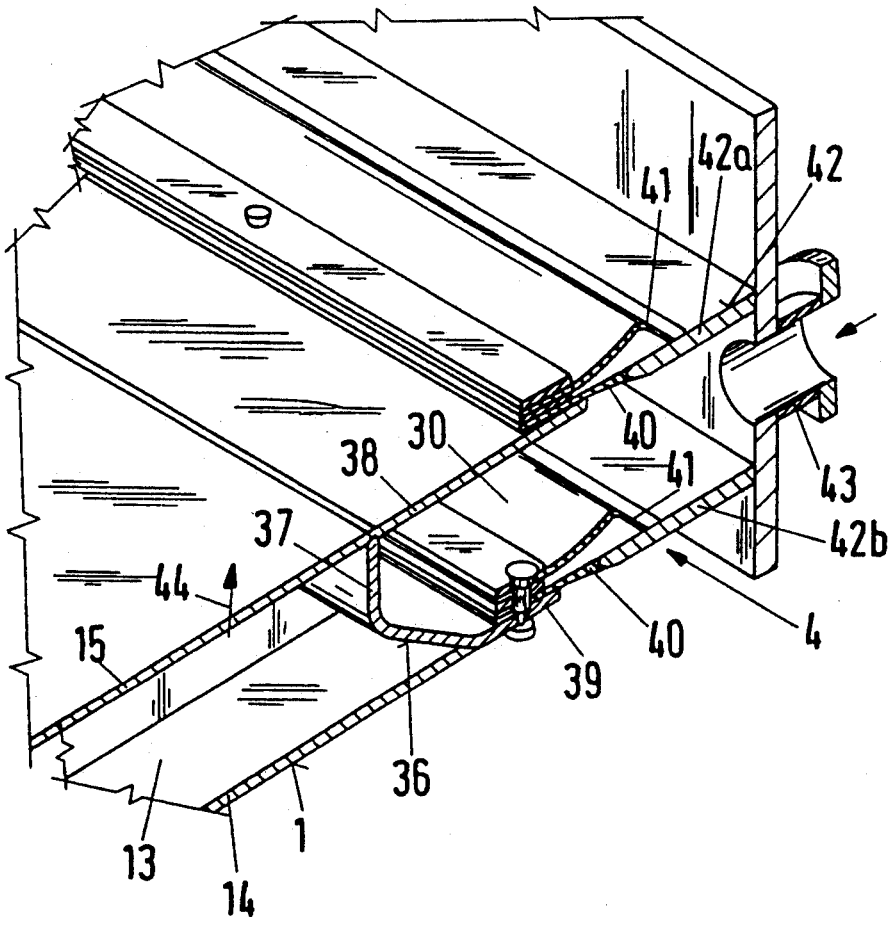

For the embodiments illustrated in relation to FIGS. 3, 4 and 5, a circumferential groove 26, 26′ forming essentially the circumferential edge, with the buffer medium partial chamber 30 bordered by the circumferential groove 26, 26′—seen in cross section—is oriented approximately perpendicular to the closed, gas-tight chamber 13 of the shutoff valve 1 and is open. On the other hand, it is also possible, as shown in FIG. 6, to have a circumferential groove or channel 36 with a U-shaped cross section in an outward-facing (toward the outer edge of the circumference) extension of the closed, gas-tight chamber 13 formed between the shutoff body 14 and the cover 15. If we consider the U-cross section of this circumferential groove 36, then the transverse web of this U forms the circumferential wall 37 closing the chamber 13 toward the circumferential edge of the valve, while in an approximately straight or linear extension of the cover 15 outward, a portion of the circumferential wall 38 is designed as a longer U-leg, and in an approximately linear extension of the shutoff body 14, one part of the circumferential wall 39 is designed as a shorter U-leg. Each of these two circumferential wall parts 38, 39, on its free end facing the housing seal seat, supports a flat, circular, elastic rubber sealing lip 40, on one side of which (in FIG. 6, on the upper side), there is a cover strip 41.

In this embodiment illustrated in FIG. 6, the housing seal seat 4 also contains a hollow body 42, which is connected by means of a connecting tube 43 to an external buffer medium pressure source. This hollow body 42—outside the external housing wall—is bordered or limited by a narrow circumferential wall 42*a* and a wide circumferential wall 42*b*, whereby the free space between these two circumferential walls 42*a*, 42*b* is the same as the free space between the circumferential wall parts 38 and 39 of the circumferential groove 36. In the shutoff position of the shutoff valve 1 illustrated in FIG. 6, moreover, the inwardly-facing free edge of the narrow circumferential wall 42*a* is opposite the outward-facing free edge of the sealing lip 40 on the longer part of the circumferential wall 38, while the inward-facing free edge of the wider circumferential wall 42*b* of the hollow body 42 is in contact with the outward-facing free edge of the sealing lip 40 of the shorter circumferential wall part 39 of the shutoff valve 1; the cover strips 41 are thereby in contact with one side surface of the corresponding circumferential wall 42*a* or 42*b* of the hollow body 42. In this manner, the shutoff valve 1 can only be opened in the direction of the arrow 44, and pivoted into the shutoff position (FIG. 6) in the direction opposite to the arrow 44.

In this case (FIG. 6), inside the circumferential groove 36 there is once again a buffer medium partial chamber 30 which is open to the outside, i.e. toward the hollow body 42, and is in an open connection with the inside of this hollow body 42, when the shutoff valve 1 is in its closed position.

Figure 7:
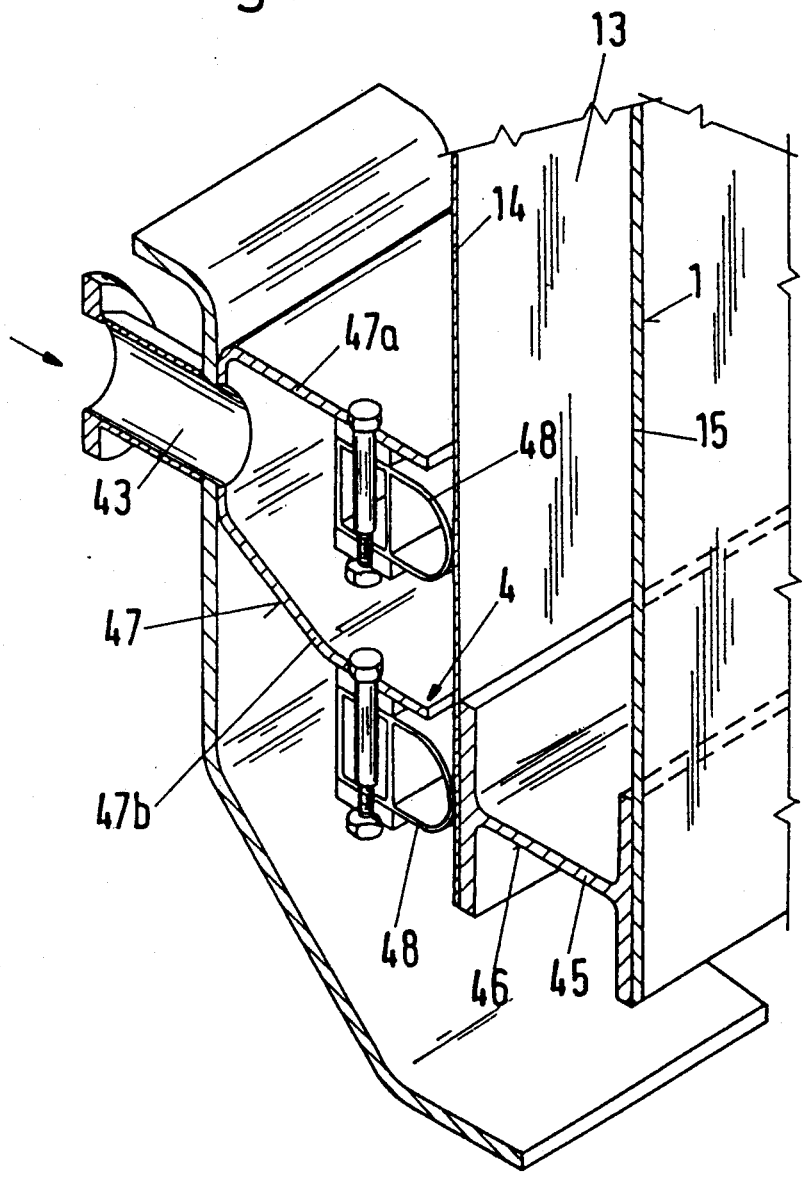

Finally, FIG. 7 shows an additional embodiment, in which there are sealing elements 48 between the seal seat hollow body 47 and the circumferential area of the valve 1, not on the valve 1, but on the seal seat hollow body 47.

FIG. 7 once again assumes that the shutoff mechanism is the shutoff valve 1, whose closed, gas-tight chamber 13 is formed essentially by the plate-shaped shutoff body 14 and the plate-shaped additional cover 15. In this case, however, the circumferential wall closing the gas-tight chamber 13 toward the circumference of the valve is formed by the web 45 of a circular steel profile 46, which is shown as a double-T or I profile in FIG. 7, but it can also be formed by another suitable steel profile, such as a U-shaped profile.

In the example illustrated in FIG. 7, the housing seal seat 4 also contains a hollow body 47, which can in turn be connected by a connecting tube 43 to an external buffer medium pressure source, to introduce the pressurized buffer medium into the inside of the hollow body 47 as explained above. The hollow body 47 in this example can be designed with an approximately U-shaped cross section, and can run in groove-like fashion over the inside circumferential area of the corresponding housing, whereby its open groove side is directed toward the facing side in the circumferential edge area of the shutoff valve 1, in particular of its shutoff body 14. The hollow body 47 thereby has two walls 47*a* and 47*b* directed toward the shutoff valve 1, which on their free edges each have a suitable circular sealing element 48, which comes into sealed engagement with the opposite side of the shutoff valve 1 when the shutoff valve 1 is in its shut off position. In the example illustrated in FIG. 7, it is once again assumed that the two circular sealing elements 48 are formed by clamped spring steel strips bent in an approximately U-shaped cross section, approximately as indicated in FIG. 4.

In summary, one feature of the invention resides broadly in a shutoff apparatus for a gas line, in particular one having a large cross section, with a gas line housing which can be integrated into the gas line and with at least one shutoff mechanism, in particular a movable shutoff valve 1, 2, whereby the shutoff mechanism has a plate-shaped shutoff body 14, which in the shutoff position is in sealed contact against a seal seat 4 permanently connected to the gas line housing, thereby separating the chambers of the gas line located on different sides of the shutoff mechanism from one another, and whereby the seal seat 4 in the peripheral region of the plate-shaped shutoff body 14 extends around its entire circumference, characterized by the fact that the shutoff mechanism 1, 2 has an additional cover 15, which together with the shutoff body 14 forms a chamber 13 closed gas-tight from the two chambers of the gas line, wherein the pressure P2 of this chamber is different from the pressure in the two chambers of the gas line P1 and P3, and which is connected to a pressure monitoring device 16.

Another feature of the invention resides broadly in a shutoff apparatus characterized by the fact that the pressure monitoring device 16 is located on the outside of the gas line housing 3, 12 and in the closable connecting line 22, 23 between the gas-tight chamber 13 and an external pressure source for a buffer medium, preferably a gaseous buffer medium.

Yet another feature of the invention resides broadly in a shutoff apparatus characterized by the fact that the pressure monitoring apparatus 16 is connected via a flexible pressure medium line 23 to the closed, gas-tight chamber 13 in the shutoff mechanism 1, 2.

A further feature of the invention resides broadly in a shutoff apparatus characterized by the fact that the movable shutoff valve 1 forming the shutoff mechanism has a circumferential wall 25, 37, 45 which encloses the gas-tight chamber 13 toward the circumferential edge of the valve, which wall 25, 37, 45 connects the plate-shaped shutoff body 14 and the also plate-shaped cover 15 to one another in the vicinity of their circumferential edges.

A yet further feature of the invention resides broadly in a shutoff apparatus characterized by the fact that this gas housing seal seat 4 contains a cavity or hollow body 31, 42, 47, which can be pressurized with buffer medium under pressure, and whose one side opposite the shutoff valve 1 can be closed by a side of the valve circumferential area 25, 26', 36, with the interposition of circular sealing elements or gaskets 28, 28', 34, 40, 48.

Yet another further feature of the invention resides broadly in a shutoff apparatus characterized by the fact that the circumferential wall 45 of the shutoff valve 1 is formed by a circular steel profile 46, in particular a U-shaped of double-T or I profile, whereby the seal seat cavity hollow body 47, on its side opposite the circumferential edge of the shutoff valve 1 is open, and supports two sealing elements 48 extending over the length of the seal seat 4 and in sealed engagement with one valve side surface 14, limiting this hollow body or cavity side.

An additional feature of the invention resides broadly in a shutoff apparatus characterized by the fact that the shutoff valve 1, in its circumferential edge area 25, 26', 36, supports two seal elements 28, 28', 34, 40 at some distance from one another which, together with the valve circumferential wall 25, 25', 37 delimit a buffer medium partial chamber 30 which is open toward the housing seal seat 4 and can be connected to the inside of the seal seat cavity 31, 42, and when the shutoff valve is closed, are pressed tight against the opposite, at least partly open side of this cavity.

A yet additional feature of the invention resides broadly in a shutoff apparatus characterized by the fact that the circumferential edge is formed essentially by a circumferential groove which has an approximately U-shaped cross section, one wall of which forms the circumferential wall which closes the chamber 13 toward the valve circumferential edge, and which limits the buffer medium partial chamber 30.

A further additional feature of the invention resides broadly in a shutoff apparatus characterized by the fact that the circular sealing elements located between the one side of the cavity 31 and the circumferential wall area of the shutoff valve 1 are formed by elastic rubber sealing strips 28, 28'.

A yet further additional feature of the invention resides broadly in a shutoff apparatus characterized by the fact that the circular sealing elements located between the one side of the cavity 31, 47 and the circumferential wall area of the shutoff valve 1 contain clamped spring steel strips 34, 48 bent approximately in a U-shaped cross section.

Another further additional feature of the invention resides broadly in a shutoff apparatus characterized by the fact that the circular sealing elements located between the one side of the cavity 31, 47 and the circumferential wall area of the shutoff valve 1 are formed by elastic rubber sealing lips 40 with corresponding cover strips 41.

A yet another additional feature of the invention resides broadly in a shutoff apparatus characterized by the fact that there are at least two shutoff valves 1, 2, which in the shutoff position are located in a common plane next to one another, whereby the seal seat for the facing edges of the shutoff valves 1, 2 are always located on a center web 35 of the gas line housing running transversely through the gas line.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A valve apparatus for a gas duct, the gas duct having a first duct chamber on a first side of the valve apparatus and the gas duct having a second duct chamber on a second side of the valve apparatus, said valve apparatus comprising:

a valve apparatus housing for being integrated into the gas duct;

a shutoff door being movably mounted on said valve apparatus housing, said shut off door for opening and closing the valve apparatus, and for selectively separating the gas duct into the first duct chamber and the second duct chamber, and for selectively shutting off gas flow between the first duct chamber and the second duct chamber;

a seal seat connected to said valve apparatus housing, said seal seat for sealing between said valve apparatus housing and said shutoff door when said shutoff door is in a closed position; and a body chamber formed within said shutoff door, said body chamber being substantially gas-tight and being separate from the first and second duct chambers, and said body chamber being configured for having a body pressure therein which body pressure is different from the pressure within the first duct chamber and also different from the pressure within the second duct chamber, said body chamber having means for connection to a source for providing the different pressure within said body chamber, and said body chamber having means for connection to a pressure monitoring device.

2. The valve apparatus of claim 1, wherein:

said shutoff door comprises a circumferential edge area; and said seal seat is configured to form a seal around said entire circumferential edge area of said shutoff door.

3. The valve apparatus of claim 2, wherein said shutoff door comprises a flat continuous body and a cover body for forming said body chamber therebetween.

4. The valve apparatus of claim 3, comprising:

a pressure monitoring device connected to said means for connection to a pressure monitoring device, said pressure monitoring device being located outside said valve apparatus housing; and a connecting line for connecting said pressure monitoring device to said means for connection to a pressure monitoring device, said connecting line for connecting an external pressure source providing a gaseous buffer medium to said means for connection to a source for providing the different pressure, and said connecting line having means for closing said connecting line.

5. The valve apparatus of claim 4, wherein said connecting line comprises a flexible pressure medium line.

6. The valve apparatus of claim 5, wherein said shutoff door comprises a circumferential wall in the vicinity of said circumferential edge area of said shutoff door, said circumferential wall connecting said flat continuous body and said cover body in the vicinity of the circumferential edges of said flat continuous body and said cover body.

7. The valve apparatus of claim 6, wherein:

said circumferential edge area of said shutoff door can be pressed against said seal seat for sealing between said valve apparatus housing and said shutoff door;

said valve apparatus comprises sealing means for being interposed between and for sealing between said circumferential edge area of said shutoff door and said seal seat when said shutoff door is in a closed position; and said seal seat comprises a cavity for being pressurized by a buffer medium, said cavity comprises means for receiving a pressurized buffer medium, said cavity is configured to be closed by said circumferential edge area and said sealing means when said shutoff door is in a closed position.

8. The valve apparatus of claim 7, wherein:

said circumferential wall of said shutoff door comprises a steel member having an I profile;

said seal seat cavity comprises an opening, said seal seat cavity opening faces towards said shutoff door;

said sealing means comprises a first circular sealing element and a second circular sealing element for sealing between said circumferential edge area of said shutoff door and said seal seat when said shutoff door is in a closed position;

said seal seat adjacent said seal seat cavity opening supports said first and second circular sealing elements, said circular sealing elements extending over the entire length of the seal seat; and said shutoff door for being in sealed contact with said first and second circular sealing elements and for limiting said seal seat cavity when said shutoff door is in a closed position.

9. The valve apparatus of claim 8, wherein said first and second circular sealing elements comprise elastic rubber sealing strips for sealing between said circumferential edge area of said shutoff door and said seal seat when said shutoff door is in a closed position.

10. The valve apparatus of claim 8, wherein said first and second circular sealing elements comprise clamped spring steel strips bent approximately in a U-shaped cross section.

11. The valve apparatus of claim 8, wherein:

said first and second circular sealing elements comprise elastic rubber sealing lips with corresponding cover strips for sealing between said circumferential edge area of said shutoff door and said seal seat when said shutoff door is in a closed position;

said shutoff door comprises hinge means for being movably mounted on said valve apparatus housing;

said valve apparatus comprises a drive apparatus having transmission means, said drive apparatus for moving said shutoff door between open and closed positions; and said drive apparatus comprises a door activation shaft, a plurality of activation arms, and a plurality of hinged connecting rods, all of which link said shutoff door to said transmission means for moving said shutoff door between open and closed positions.

12. The valve apparatus of claim 8, wherein said valve apparatus comprises at least two shutoff doors, said at least two shutoff doors being located in substantially the same plane next to one another; and said valve apparatus housing comprising a central web to which said seal seat is also connected, said central web running transversely through the gas duct.

13. The valve apparatus of claim 7, wherein:

said seal seat cavity comprises an opening, said seal seat cavity opening faces towards said shutoff door;

said sealing means comprises a fist circular sealing element and a second circular sealing element for sealing between said circumferential edge area of said shutoff door and said seal seat when said shutoff door is in a closed position;

said circumferential edge area of said shutoff door supports said first and second circular sealing elements at a distance from one another;

a buffer medium partial chamber is formed by said circumferential wall and said first and second circular sealing elements, said buffer medium partial chamber is open towards said seal seat cavity opening; and said buffer medium partial chamber and said seal seat cavity are connected by said seal seat cavity opening to form a common chamber when said shutoff door is in a closed position.

14. The valve apparatus of claim 13, wherein:

said circumferential edge area comprises a circumferential groove, said circumferential groove having an approximate U-shaped cross section having at least two walls;

said circumferential groove forming said buffer medium partial chamber;

one wall of said circumferential groove forms said circumferential wall of said shutoff door.

15. The valve apparatus of claim 14, wherein said first and second circular sealing elements comprise elastic rubber sealing strips for sealing between said circumferential edge area of said shutoff door and said seal seat when said shutoff door is in a closed position.

16. The valve apparatus of claim 14, wherein:

said first and second circular sealing elements comprise elastic rubber sealing lips with corresponding cover strips for sealing between said circumferential edge area of said shutoff door and said seal seat when said shutoff door is in a closed position;

said shutoff door comprises hinge means for being movably mounted on said valve apparatus housing;

said valve apparatus comprises a drive apparatus having transmission means, said drive apparatus for moving said shutoff door between open and closed positions; and said drive apparatus comprises a door activation shaft, a plurality of activation arms, and a plurality of hinged connecting rods, all of which link said shutoff door to said transmission means for moving said shutoff door between open and closed positions.

17. The valve apparatus of claim 14, wherein said valve apparatus comprises at least two shutoff doors, said at least two shutoff doors being located in substantially the same plane next to one another; and said valve apparatus housing comprising a central web to which said seal seat is also connected, said central web running transversely through the gas duct.

18. A valve apparatus for a gas duct, the gas duct having a first duct chamber on a first side of the valve apparatus and the gas duct having a second duct chamber on a second side of the valve apparatus, said valve apparatus comprising:

a shutoff door, for being moveable within the gas duct, for sealing against a seal seat when in the closed position thereby separating the gas duct into the first duct chamber and the second duct chamber, and for shutting off gas flow between the first duct chamber and the second duct chamber; and a body chamber formed within said shutoff door, said body chamber being substantially gas-tight and being separate from the first and second duct chambers, and said body chamber being configured for having a body pressure therein which body pressure is different from the pressure within the first duct chamber and also different from the pressure within the second duct chamber, said body chamber having means for connection to a source for providing the different pressure within said body chamber, and said body chamber having means for connection to a pressure monitoring device.

19. The valve apparatus of claim 18, wherein:

said shutoff door comprises a circumferential edge area; and said shutoff door comprises a flat continuous body and a cover body for forming said body chamber therebetween.

20. The valve apparatus of claim 19, wherein:

said shutoff door comprises a circumferential wall in the vicinity of said circumferential edge area of said shutoff door, said circumferential wall connecting said flat continuous body and said cover body in the vicinity of the circumferential edges of said flat continuous body and said cover body;

said valve apparatus comprises sealing means for being interposed between and for sealing between said circumferential edge area of said shutoff door and said seal seat when said shutoff door is in a closed position;

said sealing means comprises a fist circular sealing element and a second circular sealing element for sealing between said circumferential edge area of said shutoff door and said seal seat when said shutoff door is in a closed position;

said circumferential edge area of said shutoff door supports said first and second circular sealing elements at a distance from one another;

a buffer medium partial chamber is formed by said circumferential wall and said first and second circular sealing elements, said buffer medium partial chamber is open towards the seal seat;

said circumferential edge area comprises a circumferential groove, said circumferential groove having an approximate U-shaped cross section having at least two walls;

said circumferential groove forming said buffer medium partial chamber;

one wall of said circumferential groove forms said circumferential wall of said shutoff door; and said first and second circular sealing elements comprise one of elastic rubber sealing strips and elastic rubber sealing lips with corresponding cover strips for sealing between said circumferential edge area of said shutoff door and said seal seat when said shutoff door is in a closed position.

* * * * *